US006063744A

United States Patent [19]

McQuillen

[11] Patent Number: 6,063,744

[45] Date of Patent: May 16, 2000

[54] CLEANING AND LUBRICANT FORMULATION FOR SPINDLES

[76] Inventor: Edwin F. McQuillen, 5173 N. Channing, Fresno, Calif. 93711

[21] Appl. No.: 09/360,293

[22] Filed: Jul. 22, 1999

[51] Int. Cl.[7] ..... C10M 173/02

[52] U.S. Cl. ..... 508/532; 508/506; 508/512; 508/551; 508/579; 508/583; 508/584; 508/555; 252/8.81

[58] Field of Search ..... 508/532; 252/8.81, 252/8.86

[56] References Cited

U.S. PATENT DOCUMENTS

| | | | |
|---|---|---|---|
| 3,816,346 | 6/1974 | Coppock | 508/591 |
| 4,027,512 | 6/1977 | Treat | 72/42 |
| 4,242,861 | 1/1981 | Kirksey | 508/436 |
| 4,297,407 | 10/1981 | Manca | 252/8.81 |
| 4,446,044 | 5/1984 | Rutkiewic et al. | 252/170 |
| 4,816,336 | 3/1989 | Allou, Jr. et al. | 252/8.6 |
| 5,190,679 | 3/1993 | McDonald | 252/41 |
| 5,322,631 | 6/1994 | Fuchigami et al. | 252/33.2 |

*Primary Examiner*—Ellen M. McAvoy
*Attorney, Agent, or Firm*—Richard A. Ryan

[57] ABSTRACT

A cleaning and lubricant formulation for use on spindles on cotton picker or harvesting machines that simultaneously cleans and lubricates the surface of the spindles. The formulation features a major proportion of water and amounts of unsaturated fatty acids, glycol ether and alcohol solvents, nonionic surfactant, amide cosurfactant, and polycarboxylic acid. An alkalizing agent is added to control the pH of the resulting formulation. The cleaning and lubricant formulation exhibits excellent cleaning and lubrication properties without utilizing petroleum oil that can contaminate cotton fields, water supplies or the harvested cotton.

20 Claims, No Drawings

CLEANING AND LUBRICANT FORMULATION FOR SPINDLES

BACKGROUND OF THE INVENTION

1. Field of the Invention

The field of the present invention relates generally to formulations that simultaneously clean and lubricate a surface. More particularly, the present invention relates to such formulations which clean the surface of cotton picker spindles and simultaneously leave a lubricant layer on the cleaned spindles.

2. Background

Mechanized cotton harvesters, commonly referred to as cotton pickers, remove cotton from the cotton plants and deposit the removed cotton into a basket or receptacle. Many common cotton pickers, such as the John Deere model 9960 Cotton Picker and the Case-IH model 2055 Cotton Picker are of the spindle type design. These cotton pickers have individual row units which operate to separate the cotton from the cotton plants as the cotton picker travels through a field of cotton plants. As the cotton picker moves through the field of plants, stalk lifters mounted on the front of the row unit introduce cotton stalks into the row units for processing. As the cotton stalks are directed rearwardly through the row unit, spindles on rotating picker drums physically separate the cotton from the plants. Doffer units remove the cotton from the spindles and feed the separated cotton into an air stream that deposits the cotton into the basket or receptacle at the rear of the cotton picker.

The picker drums, which rotate about their axis, have a plurality of tapered spindles extending outwardly from the surface of the picker drum. As the picker drum rotates about its axis, the spindles rotate about their longitudinal axis. The surface of the spindles contain a rows of barbs. As the cotton stalks feed through the row unit, the dual rotation of the spindles breaks up the cotton stalks and removes the cotton therefrom. This action causes the cotton to wrap around the spindles. The cotton-wrapped spindles pass under the doffer mechanism which unwinds the cotton from the spindles and pushes it off the end of the spindle into the air stream for delivery to the cotton basket.

The typical doffer mechanism comprises one or more rotating doffer disks. The rotating action of the doffer disks effectively peel the cotton from the spindles. The doffer disks do not contact the spindles in order to unwind the cotton from the spindle, instead they rotate approximately 0.010 inches above the spindles. Any contact will result in excessive wear for the spindle and doffer disks components of the cotton picker, which generally results in undesirable downtime for the cotton picker to replace or readjust the doffer disks. However, because the cotton can be tightly wrapped about the spindle between the barbs, it often does require a significant amount of doffing force to unwind the cotton axially off the spindles. This force can still damage the spindles or doffer disks. To reduce the likelihood of damage, the typical cotton picker utilizes moisture units to supply lubrication to the spindles to ease the removal of the cotton from the spindles and reduce the wear on the spindle and doffer disks. The moisture units typically comprise a series of pads connected to a supply of moisturizing fluid. These pads are constantly supplied with fluid and are positioned to effectively contact the spindles as the drum rotates them past the moisture unit. Various fluid lines deliver the moisturizing fluid under pressure from the fluid supply to the pads.

In order to obtain maximum efficiency of the spindle action for picking cotton, it is important that the spindles are cleaned of cotton, cotton-related materials such as plant juices and plant debris, and dust before the spindles rotate to receive and process cotton. The doffing action of the doffer disks does not remove all of this material. Any cotton or debris that is left on the spindles can damage the moisture pads and, in more severe cases, result in the drum clutch slipping as the wrapped spindle attempts to pass through the moisturizing assembly. This typically requires the cotton picker to be shut down and the spindles manually accessed. The scrubbing action of the pads against the spindles does provide some cleaning action. However, to facilitate the action of the doffer disks and the pads, most cotton farming operations utilize a moisturizing fluid that contains some amount of cleaning solution and lubricant. The cleaning solution helps remove cotton and other debris from the spindles. The lubricant provides a barrier to reduce wear on the spindles and doffer disks and provides additional cotton removing capability by reducing the ability of the cotton to stick to the spindles.

The typical spindle moisturizing fluid comprises a base water soluble petroleum oil with a friction reducing agent and a number of other additives, such as viscosity improvers, antifoam agents, antioxidants and the like, added to the base oil. One such product is described in U.S. Pat. No. 3,816,346 issued on Jun. 11, 1974 to Coppock. As with the moisturizing fluid described in the '346 patent, most commonly available moisturizing fluids utilize a water soluble petroleum product as the base material. The use of a petroleum product as the base material for the moisturizing fluid has a number of potentially serious problems. One such problem is related to the general handling and distribution of an oil-based product on farming property. Environmental concerns, such as contamination of the soil or water supplies, can arise if any of the product is spilled while filling the fluid storage container or as an inherent result of the spraying or dripping of the oil-based product from the pads during the cleaning and moisturizing process. In addition, oil contaminated cotton can cause ginning and manufacturing problems, such as smoke from ginning units and the inability to utilize certain dyes. Another problem that can arise is contamination of the cotton itself from the oil-based product. Too much of the oil-based product in the moisturizing fluid can contaminate the harvested cotton and result in a lower value for the cotton. Another potential problem is the accumulation of cotton around the doffer mechanism has been known to create frictional forces to build against the doffer mechanism. In the worst case, these frictional forces can result in a fire. Yet another disadvantage of using oil-based fluids is the separation of the oil-based moisturizer from the water in which it is diluted.

Some cotton operations avoid the problems and costs associated with oil-based cleaners and lubricants by utilizing water as the cleaning and lubricating agent. However, water alone is generally not satisfactory as a cleaning or lubricating fluid. Some previously available water-based moisturizing fluids have utilized chemicals that are now considered carcinogenic, or which are either expensive to use or difficult to obtain. Consequently, a need exists for a cleaning and lubricating formulation for cotton picker spindles that effectively cleans off cotton and cotton-related materials from the spindles and provides a layer of lubricant to reduce the wear on the spindles and doffer disks and assist with the doffing of the cotton from the spindle.

SUMMARY OF THE INVENTION

The cleaning and lubricating formulation of the present invention provides the benefits and solves the problems identified above. That is to say, the present invention provides a cleaning and lubrication formulation for spindles used in cotton pickers that effectively cleans off the spindles and provides a layer of lubricant on the spindle. The lubricant on the spindles reduces wear to the spindles and the doffer disks which unwind the cotton from the spindle.

The cleaning and lubricating formulation of the present invention utilizes water as the base fluid and, as such, solves the problems associated with the use of a petroleum product as the base material. The formulation of the present invention cleans the surface of the spindles by removing cotton and cotton-related materials from the spindles. In addition, the formulation of the present invention places a layer of lubricant on the spindles to further assist with the removal of the cotton and reduce wear to the spindles and doffer disks. Besides providing a formulation which has increased cleaning and lubricating qualities, the chemicals utilized in the formulation of the present invention are generally biodegradable and not harmful to the cotton fields or harvested cotton.

Accordingly, the primary objective of the present invention is to provide a cleaning and lubrication formulation for spindles that effectively cleans cotton picker spindles while simultaneously lubricating the spindles to maintain spindle efficiency and reduce doffer wear.

It is also an important objective of the present invention to provide a spindle cleaning and lubrication formulation that is non-toxic to humans and generally biodegradable.

It is also an important objective of the present invention to provide a spindle cleaning and lubrication formulation that does not utilize petroleum oil.

It is also an important objective of the present invention to provide a spindle cleaning and lubrication formulation that can be utilized in the typical cotton picker moisturizing system.

These and other objectives of the invention are satisfied in accordance with the present invention, which is described in greater detail below.

In accordance with one aspect of the preferred embodiment of the present invention, the cleaning and lubricating formulation comprising the following constituents, in percent by weight:

8–12% unsaturated fatty acid;

2–4% glycol ether solvent;

2–4% alcohol solvent;

2–4% alkoxylated phenol (nonionic surfactant);

3–7% amide cosurfactant (fatty acid alkanolamides);

0–4% polycarboxylic acid (acylating agent);

0.5–2% alkalizing agent (i.e., caustic soda);

to 100% water.

The cleaning and lubrication formulation for cotton picker spindles of the present invention includes specific amounts of an unsaturated fatty acid, glycol ether compounds, alcohol solvent, one or more water soluble nonionic surfactants, dicarboxylic acid and caustic soda mixed in water to provide the characteristic desired by the present invention.

As is noted above, the formulation according to the present invention utilizes water as the base material. The water may be tap water, but it must be clean. If the water is tap water, it should be substantially free of any undesirable impurities such as organics and inorganics, especially mineral salts present in hard water which could distract from the operation of one or more of the essential constituents of the present invention. Water is added to provide 100% by weight of the cleaning and lubrication formulation. Desirably, the water forms approximately 70% to 75% of the total weight, with the preferred formulation, as set forth below, resulting in approximately 73% of water of the total weight of the spindle cleaning and lubrication formulation of the present invention.

The formulation of the present invention comprises a long chain unsaturated fatty acid, such as tall oil. The preferred long chain unsaturated fatty acid of the present invention has about 8 to 24 carbon atoms, more preferably about 10 to about 20 carbon atoms. The preferred unsaturated fatty acid is refined tall oil fatty acid, such as is currently available from Westvaco Chemical Corporation.

Although the inventor has not experimented with all variations of chemicals, it is anticipated that other unsaturated fatty acids could be usable in the instant composition. For instance, the fatty acid used in the present invention could be selected from the group consisting of tall oil fatty acid, linseed oil, soybean oil, coconut oil, castor oil, sunflower oil, safflower oil, tung oil, lauric, palmitic, stearic, oleic, linoleic and linolenic. Approximately 8% to 12% of tall oil fatty acid, or other unsaturated fatty acid, by weight is mixed in liquid form with the water, with the preferred amount being approximately 10%. The tall oil fatty acid, in particular, is a surface active agent that has suitable anionic properties and provides slicking benefits with regard to the formulation of the present invention.

The cotton picker spindle cleaning and lubricant formulation taught herein also includes a glycol ether solvent constituent. The glycol ether is a solubilizing agent that acts as a foam regulator by reducing the interfacial tension at the interface between the emulsion droplets and the aqueous phase to a very low value. A preferred glycol ether solvent is ethylene glycol n-butyl ether, available from Van Waters & Rogers, Inc. as Glycol Ether E.B., which has been found to provide the benefits sought for the formulation of the present invention. Exemplary glycol ethers which may also be advantageously employed as the solvent constituent is one or more of the solvents of the group consisting of diethylene glycol methyl ether, diethylene glycol n-butyl ether, ethylene glycol hexyl ether, diethylene glycol hexyl ether, and mixtures thereof. These materials are presently commercially available from the Dow Chemical Co. or Union Carbide Corp.

The glycol ether constituent is preferably employed in an amount sufficient to sufficiently solubilize the cleaning and lubricant formulation of the present invention so that it is not overly viscous or gelatinous in nature, but rather exhibits a flow viscosity similar to water. Such a viscosity characteristic is particularly beneficial for flow through the numerous small lines from the supply to the pads and for dispersment from the pad to the spindles. The inventor has found that a glycol ether constituent of 2% to 4% by weight works well with the present invention, with the desired glycol ether constituent being approximately 3% by weight of the total formulation of the present invention.

The formulation according to the present invention also includes an alcohol constituent that provides additional solubilizing effect to further reduce foaming. The alcohol selected should be a water soluble alcohol that is desirably selected to exhibit good aqueous solubility and efficiency as a solvent. The desired alcohols are generally the lower alkyl alcohols that are volatile so that may readily volatize from the surface of the spindles or elsewhere. Although various water soluble alcohols, particularly the C1-6 alcohols, may be used, the preferred alcohol is isopropyl alcohol, which is well known in the art and widely commercially available as Carbinol. The typical range for the alcohol constituent is 2% to 4% by weight of the total weight of the formulation, with approximately 3% being the usual preferred amount and typically effective to reduce foaming.

The cotton picker spindle cleaning and lubricant formulation taught herein also includes one or more surfactant constituents. At least one of the surfactants should be a dispersant to promote the dispersion of the active ingredients in the water carrier and keep those ingredients uniformly suspended therein. One suitable class of chemicals for this purpose are the alkoxylated phenols, particularly the nonionic ethoxylated phenols. The selected surfactant should be water soluble and sufficiently break down the surface tension among the various other ingredients in the water. The inventor of the present invention has found that one such suitable dispersant is VANWET 9N9, which is currently available from Univar Corporation out of Seattle, Wash. This surfactant is a water soluble, nonionic, ethoxylated phenol that can effectively function as both a wetting agent and a dispersant. In the formulation of the present invention, the inventor has found that a range of approximately 2% to 4% by weight of the total weight works well and provides the desired benefits, with the preferred amount of this surfactant being approximately 3% of the total weight.

The formulation of the present invention also includes an amide cosurfactant that is preferably selected from the group of fatty acid alkanolamides that are derived from alkanol amines. The diethanolamide of coconut fatty acids (cocomide diethanolamide) and mixtures thereof are most preferred and are exemplified by NINOL 40-CO. NINOL 40-CO is a coca fatty acid alkanolamide derived from diethanolamide and is currently available from by Stepan Chemical Company. For the present formulation, the amide cosurfactant should be selected for its desired surfactant and thickener properties. NINOL 40-CO has the added benefit of providing additional cleaning agent properties which assist in the removal of cotton and other debris from the cotton picker spindles. In the preferred formulation of the present invention, the range of amide cosurfactant necessary to accomplish the objectives of the invention has been found to be 3% to 7%, with the preferred amount being approximately 5%.

The preferred cotton picker spindle cleaning and lubricant formulation of the present invention also includes a polycarboxylic acid such as an acylating agent. One such agent is dicarboxylic acid, such as that which is currently commercially available from Westvaco Corporation under the trade name DIACID H-240. Dicarboxylic acids are the reaction products of an unsaturated fatty acid with an alpha, beta-ethylenically unsaturated carboxylic acid and are well known in the art (as set forth in U.S. Pat. No. 2,444,328). The inventor has found that the use of the dicarboxylic acid has the benefit of helping to hold the formulation together. Prior to using this chemical, the inventor was having some separation problems, which were virtually eliminated by the addition of DIACID H-240. Generally, a range of 0% to 4% by weight of this material is sufficient to obtain the desired properties set forth herein. The inventor has found that the preferred amount is approximately 2% of the dicarboxylic acid by weight of the total weight.

The formulation of the present invention is preferably alkalized by the addition of caustic soda in an amount sufficient to bring the pH of the formulation into the desired range. Although other alkalizing materials may also work well, the inventor has found that caustic soda serves well to control the pH of the present formulation. The caustic soda also helps hold the formulation together and serves as a blending agent. In the preferred embodiment of the present invention, sufficient caustic soda is added to the mixed formulation into the desired pH range of 10 to 11. Preferably, the inventor desires to obtain a pH of approximately 10.5 for the complete mixed formulation. A pH value much below 9 generally results in separation problems and a pH above 12 generally results in the formulation drying too fast on the spindles, particularly in hot weather. A pH value of 13 is generally too caustic to use for the desired purpose of the present invention. A pH value of around 10.5 tends to hold together well and not dry too fast. Prior to adding the caustic soda, the pH of the mixture is generally below 7. Caustic soda is added until the pH of the mixture is at or near 10.5, which generally requires approximately 0.5% to 2% by weight of caustic soda. The typical amount of caustic soda required is approximately 1% of the total weight of the mixture.

The preferred formulation of the cleaning and lubricant of the present invention is achieved by adding the various constituents described above in their desired quantities to water. Generally, though not required, the inventor first adds the unsaturated fatty acid (i.e., tall oil) in an amount that will be approximately 10% of the total weight to the water, which will generally be approximately 73% of the total weight. Then the glycol ether and the isopropyl alcohol are added such that these constituents will each be approximately 3% of the total weight of the final formulation. The alkoxylated phenol (nonionic surfactant) is added in an amount that is approximately 3% of the final total weight. Following this, the amide cosurfactant (i.e., the cocomide diethanolamide) is added in an amount of 5% of the total weight and then 2% of the total weight of the polycarboxylic acid (acylating agent) is added to the mixture. The mixture is mixed in a conventional, commercial electric mixer. The inventor has found that a mixer that mixes the constituents at approximately 300 rpm works well to sufficiently mix the formulation of the present invention without causing undesirable foaming. Lastly, the caustic soda alkalizing agent is added to raise the pH to the desired 10 to 11 range (preferably around 10.5).

In use, approximately 1 gallon of the cleaning and lubricating formulation of the present invention is added to approximately 100 gallons of water. Under certain conditions more or less of the present formulation may be used in the 100 gallons of water. For instance, higher temperatures may require more water component to keep the spindles in a wetted condition. If so, ¾ to 1 gallon of the formulated mixture may be added to 100 gallons of water. Likewise, if the cotton is wet or still green, the cotton producer may want to use less water to clean the spindles to avoid compounding the problems. Under this circumstance, the operator may want to use 1 to 1¼ gallons of the formulated mixture per 100 gallons of water to clean the spindles.

The diluted formulation will be placed in the fluid supply tank found on the typical cotton picker, where it will be fed through the supply lines to the pads for placement on the spindles during the normal operation of the cotton picker. Prior to placing the diluted formulation into the supply tank, the supply tank and lines should be completely flushed of any other chemicals. This should be done to avoid mixing the formulation with soluble oils, cleaners or wetting agents, which can cause the mixture to clabber and plug the lines or any filters that are used.

As cotton stalks are introduced into the row units, the spindles separate the cotton from the cotton plants. The doffer disks rotate slightly above the spindles to cause the cotton to effectively peel the cotton off the end of the spindle and feed the cotton into the air stream where it is deposited into the cotton basket on the cotton picker unit. Because the constituents of the present invention are all completely water soluble, the diluted formulation mixture will not separate in the storage tanks while waiting for use and, therefore, will not require the use of field mixers to stir the product. The lack of petroleum oil avoids contamination of the cotton fields, harvesting equipment and the cotton itself.

DETAILED DESCRIPTION OF THE PREFERRED EMBODIMENTS

To demonstrate the formulation according to the present invention, the following example is intended to illustrate the invention without limiting it in any way. In accordance with a particularly preferred aspect of the present invention, there is provided a cleaning and lubricating formulation consisting essentially of the following constituents per 100% weight:

10% tall oil;

3% glycol ether;

3% isopropyl alcohol;

3% nonionic surfactant;

5% cocomide diethanolamide;

2% dicarboxylic acid;

approximately 1% caustic soda sufficient to obtain a pH value of approximately 10.5;

to 100% water.

The present inventive formulation is simply produced by mixing measured amounts of the individual constituents to form a homogenous mixture therefrom. This may be done by well known techniques, and is desirably done in a simple commercial electric mixer, stirrer or other low shear liquid mixing apparatus so as to avoid undesired foaming of the formulation. The mixture is then used by diluting approximately 1 gallon of the formulation in approximately 100 gallons of water.

While there is described herein certain specific alternative forms of the invention, it will be readily apparent to those skilled in the art that the invention is not so limited, but is susceptible to various modifications without departing from the spirit and scope of the invention.

What is claimed is:

1. A cleaning and lubrication formulation for spindles, comprising:

8–12% weight unsaturated fatty acid;

2–4% weight glycol ether solvent;

2–4% weight alcohol solvent;

2–4% weight alkoxylated phenol;

3–7% weight amide cosurfactant;

0–4% weight polycarboxylic acid;

0.5–2% weight alkalizing agent;

to 100% weight water.

2. The cleaning and lubrication formulation according to claim 1, wherein said unsaturated fatty acid is tall oil.

3. The cleaning and lubrication formulation according to claim 2, wherein said tall oil is present in an amount of from 9% to 11% weight.

4. The cleaning and lubrication formulation according to claim 1, wherein said glycol ether solvent is ethylene glycol n-butyl ether.

5. The cleaning and lubrication formulation according to claim 1, wherein said alcohol solvent is isopropyl alcohol.

6. The cleaning and lubrication formulation according to claim 1, wherein said alkoxylated phenol is suitable as a dispersant.

7. The cleaning and lubrication formulation according to claim 1, wherein said alkoxylated phenol is a nonionic ethoxylated phenol surfactant.

8. The cleaning and lubrication formulation according to claim 1, wherein said amide cosurfactant is selected from the group of fatty acid alkanolamides that are derived from alkanol amines.

9. The cleaning and lubrication formulation according to claim 1, wherein said amide cosurfactant is cocomide diethanolamide.

10. The cleaning and lubrication formulation according to claim 1, wherein said polycarboxylic acid is dicarboxylic acid.

11. The cleaning and lubrication formulation according to claim 1, wherein said alkalizing agent is caustic soda.

12. The cleaning and lubrication formulation according to claim 1, wherein said formulation has a pH in the range of about 9 to about 11.

13. The cleaning and lubrication formulation according to claim 1, wherein said formulation has a pH of about 10.5.

14. A cleaning and lubrication formulation for spindles, comprising:

10% weight unsaturated fatty acid;

3% weight glycol ether solvent;

3% weight alcohol solvent;

3% weight alkoxylated phenol;

5% weight amide cosurfactant;

2% weight polycarboxylic acid;

1% weight alkalizing agent;

to 100% weight water.

15. The cleaning and lubrication formulation according to claim 14, wherein said unsaturated fatty acid is tall oil.

16. The cleaning and lubrication formulation according to claim 14, wherein said glycol ether solvent is ethylene glycol n-butyl ether.

17. The cleaning and lubrication formulation according to claim 14, wherein said alcohol solvent is isopropyl alcohol.

18. The cleaning and lubrication formulation according to claim 14, wherein said amide cosurfactant is cocomide diethanolamide.

19. The cleaning and lubrication formulation according to claim 14, wherein said formulation has a pH of about 10.5.

20. A cleaning and lubrication formulation for spindles, comprising:

10% weight tall oil;

3% weight glycol ether solvent;

3% weight isopropyl alcohol;

3% weight alkoxylated phenol;

5% weight amide cosurfactant;

2% weight polycarboxylic acid;

1% weight alkalizing agent;

to 100% weight water, said formulation having a pH of about 10.5.

* * * * *